US010476194B2

(12) United States Patent
Hashimoto et al.

(10) Patent No.: US 10,476,194 B2
(45) Date of Patent: Nov. 12, 2019

(54) CONNECTOR

(71) Applicant: Sumitomo Wiring Systems, Ltd., Yokkaichi, Mie (JP)

(72) Inventors: Norihito Hashimoto, Mie (JP); Wataru Yamanaka, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/108,869

(22) Filed: Aug. 22, 2018

(65) Prior Publication Data

US 2019/0081428 A1 Mar. 14, 2019

(30) Foreign Application Priority Data

Sep. 20, 2017 (JP) ..... 2017-174720

(51) Int. Cl.

| | |
|---|---|
| ***H01R 13/436*** | (2006.01) |
| ***H01R 13/426*** | (2006.01) |
| ***H01R 13/05*** | (2006.01) |
| ***H01R 13/629*** | (2006.01) |
| ***H01R 13/502*** | (2006.01) |
| ***H01R 13/422*** | (2006.01) |

(52) U.S. Cl.

CPC ..... *H01R 13/4365* (2013.01); *H01R 13/055* (2013.01); *H01R 13/426* (2013.01); *H01R 13/4223* (2013.01); *H01R 13/502* (2013.01); *H01R 13/629* (2013.01)

(58) Field of Classification Search

CPC .. H01R 13/424; H01R 13/426; H01R 13/436; H01R 13/4361; H01R 13/4362; H01R 13/4364; H01R 13/4365; H01R 13/4367; H01R 13/4368

See application file for complete search history.

(56) References Cited

U.S. PATENT DOCUMENTS 5,746,624 A * 5/1998 Ohsumi ..... H01R 13/6315 439/595
5,820,411 A * 10/1998 Okabe ..... H01R 13/424 439/595
6,106,340 A * 8/2000 Myer ..... H01R 13/4367 439/595
6,165,011 A * 12/2000 Fukuda ..... H01R 13/4223 439/595
6,478,620 B1 * 11/2002 Bonavita ..... H01R 12/7005 439/589

(Continued)

FOREIGN PATENT DOCUMENTS

JP 2015-144103 8/2015

*Primary Examiner* — Ross N Gushi
(74) *Attorney, Agent, or Firm* — Gerald E. Hespos; Michael J. Porco; Matthew T. Hespos

(57) ABSTRACT

A connector includes a housing (10) formed with a terminal accommodating portion (11), terminal fittings (15) to be inserted into the terminal accommodating portion (11) from behind, a front retainer (30) to be assembled with the housing (10) from front, and locking surfaces (29) formed in the terminal accommodating portion (11) and configured to hold the front retainer (30) and the housing (10) in an assembled state by having locking projections (37) of the front retainer (30) locked thereto from behind. The locking surfaces (29) are inclined with respect to an assembling direction of the front retainer 30 with the housing (10).

6 Claims, 15 Drawing Sheets

(56) References Cited

U.S. PATENT DOCUMENTS 6,599,150 B1 * 7/2003 Martin ..... H01R 13/4364 439/595
6,607,407 B2 * 8/2003 Takatsuki ..... H01R 13/4365 439/271
6,626,702 B2 * 9/2003 Kurimoto ..... H01R 13/4364 439/595
6,638,108 B2 * 10/2003 Tachi ..... H01R 13/4223 439/540.1
6,652,328 B2 * 11/2003 Suzuki ..... H01R 13/4365 439/595
6,655,993 B1 * 12/2003 Yamamoto ..... H01R 13/4223 439/595
6,669,508 B2 * 12/2003 Nakamura ..... H01R 13/4364 439/595
6,669,510 B2 * 12/2003 Yamawaki ..... H01R 13/6273 439/357
6,682,366 B2 * 1/2004 Tanaka ..... H01R 13/4223 439/595
6,699,079 B2 * 3/2004 Machida ..... H01R 13/4368 439/595
6,712,635 B1 * 3/2004 Nimura ..... H01R 13/6272 439/352
6,716,069 B2 * 4/2004 Nakamura ..... H01R 13/4365 439/595
6,736,675 B2 * 5/2004 Kato ..... H01R 13/4364 439/352
6,764,334 B2 * 7/2004 Tsuji ..... H01R 13/4223 439/595
6,786,768 B2 * 9/2004 Murakami ..... H01R 13/4365 439/271
6,827,609 B1 * 12/2004 Martin ..... H01R 13/4365 439/595
6,851,977 B2 * 2/2005 Tsuji ..... H01R 13/4223 439/595
6,863,568 B2 * 3/2005 Nakamura ..... H01R 13/4364 439/595
6,913,494 B2 * 7/2005 Ward ..... H01R 13/4365 439/352
6,948,978 B2 * 9/2005 Itou ..... H01R 13/4223 439/595
7,063,578 B2 * 6/2006 Goto ..... H01R 13/4223 439/595
7,066,773 B1 * 6/2006 Martin ..... H01R 13/4365 439/752
7,097,503 B2 * 8/2006 Tsuji ..... H01R 13/4365 439/595
7,112,104 B2 * 9/2006 Sagawa ..... H01R 13/4365 439/595
7,114,997 B2 * 10/2006 Sagawa ..... H01R 13/4365 439/752
7,140,908 B2 * 11/2006 Katsuma ..... H01R 13/4364 439/489
7,207,841 B2 * 4/2007 Machida ..... H01R 13/4223 439/595
7,252,556 B2 * 8/2007 Anbo ..... H01R 13/4367 439/357
7,264,505 B2 * 9/2007 Miyakawa ..... H01R 13/4364 439/595
7,448,894 B2 * 11/2008 Tsuji ..... H01R 13/4364 439/271
7,470,157 B2 * 12/2008 Hiramatsu ..... H01R 13/4365 439/595
7,476,133 B2 * 1/2009 Tanaka ..... H01R 13/4364 439/752
7,722,414 B2 * 5/2010 Tanaka ..... H01R 13/4365 439/595
7,785,146 B2 * 8/2010 Chazottes ..... H01R 13/4365 439/595
7,867,028 B2 * 1/2011 Brown ..... H01R 13/4223 439/595
7,867,042 B2 * 1/2011 Shuey ..... H01R 13/4365 439/595
7,896,696 B2 * 3/2011 Hamai ..... H01R 13/4368 439/595
7,988,489 B2 * 8/2011 Schmitt ..... H01R 13/4223 439/595
7,993,170 B2 * 8/2011 Nakata ..... H01R 4/185 439/587
8,226,436 B2 * 7/2012 Suzuki ..... H01R 13/113 439/595
8,408,950 B2 * 4/2013 Jeon ..... H01R 13/4365 439/752
8,419,471 B2 * 4/2013 Suzuki ..... H01R 13/4223 439/595
8,475,207 B2 * 7/2013 Obata ..... H01R 13/4223 439/595
8,550,860 B2 * 10/2013 Dick ..... H01R 13/4365 439/595
8,602,819 B2 * 12/2013 Uchida ..... H01R 13/502 439/596
8,641,458 B2 * 2/2014 Matsumura ..... H01R 13/4364 439/595
8,678,865 B2 * 3/2014 Hiraishi ..... H01R 13/4365 439/595
8,678,866 B2 * 3/2014 Hiraishi ..... H01R 13/4365 439/595
8,708,739 B2 * 4/2014 Takeda ..... H01R 13/4365 439/595
8,784,133 B2 * 7/2014 Suzuki ..... H01R 13/4223 439/595
9,017,111 B2 * 4/2015 Zheng ..... H01R 13/4223 439/595
9,407,025 B2 * 8/2016 Hashimoto ..... H01R 13/432
9,484,684 B2 * 11/2016 Tanikawa ..... H01R 13/6275
9,543,697 B2 * 1/2017 Nakashima ..... H01R 13/641
9,640,905 B2 * 5/2017 Suzuki ..... H01R 13/6271
9,728,884 B1 * 8/2017 Sinha ..... H01R 13/4364
9,774,123 B2 * 9/2017 Sasaki ..... H01R 13/4365
9,960,540 B2 * 5/2018 Sinha ..... H01R 13/506
2001/0006861 A1 * 7/2001 Ohsumi ..... H01R 13/4223 439/752
2001/0055907 A1 * 12/2001 Murakami ..... H01R 13/4365 439/595
2002/0076995 A1 * 6/2002 Kurimoto ..... H01R 13/4362 439/752
2002/0076996 A1 * 6/2002 Murakami ..... H01R 13/4365 439/752.5
2002/0168895 A1 * 11/2002 Suzuki ..... H01R 13/4365 439/595
2003/0157820 A1 * 8/2003 Tsuji ..... H01R 13/4223 439/145
2003/0157835 A1 * 8/2003 Ishikawa ..... H01R 13/4223 439/595
2005/0048837 A1 * 3/2005 Ichida ..... H01R 13/4367 439/595
2005/0090148 A1 * 4/2005 Sagawa ..... H01R 13/4365 439/595
2005/0124216 A1 * 6/2005 Sagawa ..... H01R 13/4365 439/595
2005/0186842 A1 * 8/2005 Fukatsu ..... H01R 13/4223 439/595
2008/0009201 A1 * 1/2008 Hiramatsu ..... H01R 13/4365 439/752
2012/0309219 A1 * 12/2012 Hiraishi ..... H01R 13/4223 439/352
2013/0315662 A1 * 11/2013 Kida ..... H01R 43/20 403/280
2014/0127928 A1 * 5/2014 Kida ..... H01R 13/4223 439/345
2015/0222041 A1 8/2015 Horiuchi
2015/0263451 A1 * 9/2015 Hashimoto ..... H01R 13/432 439/353
2018/0331452 A1 * 11/2018 Iida ..... H01R 13/501

* cited by examiner

CONNECTOR

BACKGROUND

Field of the Invention

The invention relates to a connector.

Related Art

Japanese Unexamined Patent Publication No. 2015-144103 discloses a connector including a housing formed with a terminal accommodating portion. A terminal fitting is inserted into the terminal accommodating portion from behind the housing. A front retainer is assembled with a front part of the housing from the front and is configured to detect an inserted state of the terminal fitting. The terminal accommodating portion includes a base extending along an inserting direction of the terminal fitting, a front wall projecting substantially at a right angle from a front end of the base, a tab insertion recess formed by recessing a projecting edge of the front wall and a lock projecting from a front part of a side edge of the base and linked to the front wall.

The front retainer is formed with a butting portion that is in contact with the housing from the front when the front retainer is assembled with the front part of the housing. The front retainer also has a locking projection that is locked to the lock from behind, to hold the front retainer assembled with the housing.

The housing and the front retainer are made of synthetic resin. Thus, dimensional tolerances and assembly tolerances are unavoidable, and rattling may occur between the locking projection and the lock when the front retainer is assembled with the housing.

The invention was completed on the basis of the above situation and aims to prevent the rattling when a front retainer is assembled with a housing.

SUMMARY

The invention is directed to a connector with a housing formed with a terminal accommodating portion, and a terminal fitting to be inserted into the terminal accommodating portion from behind the housing. A front retainer to be assembled with a front part of the housing from the front. A locking surface is formed in the terminal accommodating portion and is configured to hold the front retainer and the housing in an assembled state by having a locking projection of the front retainer locked thereto from behind. The locking surface is inclined with respect to an assembling direction of the front retainer with the housing.

With the front retainer and the housing assembled, a positional relationship of the locking surface and the locking projection in a front-rear direction may vary due to dimensional tolerances and assembly tolerances. However, the locking surface is inclined with respect to the assembling direction of the front retainer. Thus, the locking surface and the locking projection are kept locked ratting can be prevented.

The terminal accommodating portion may include a base extending along an inserting direction of the terminal fitting and a front wall extending substantially at a right angle from a front end of the base. A tab insertion recess is formed in a projecting end of the front wall. A lock projects rearward from a side edge of the front wall and is linked to the base via a wall, and the locking surface is formed on a rear end surface of the lock. A front wall that is formed with the tab insertion recess could deform to incline toward the tab insertion recess by being pushed by the locking projection in the process of assembling the front retainer with the housing. However, the lock is linked to the base via the wall and projects from the side edge of the front wall. Thus, the front wall is not inclined toward the tab insertion recess even if pushed by the locking projection.

The front retainer may have a butting portion configured to be in contact with the housing from the front in a state assembled with the housing, and the locking projection is locked to bite into the locking surface with the butting portion butting against the housing. Thus, rattling between the front retainer and the housing can be reliably prevented.

The front retainer may be displaceable in a front-rear direction between a partial locking position and a full locking position. The terminal fitting can be inserted into and withdrawn from the terminal accommodating portion when the front retainer is in the partial locking position. However, the terminal fitting is retained in the terminal accommodating portion when the front retainer is in the full locking position. The front retainer has a retaining projection that can be locked to the locking surface to restrict separation of the front retainer at the partial locking position. This configuration prevents rattling between the front retainer and the housing even with the front retainer held at the partial locking position.

The locking projection may be locked to the housing from the front and the retaining projection may bite into the locking surface with the front retainer held at the partial locking position. According to this configuration, rattling between the front retainer and the housing can be reliably prevented with the front retainer held at the partial locking position.

The locking projection is locked to bite into the locking surface with the front retainer held at the full locking position, and a biting position of the locking projection into the locking surface and a biting position of the retaining projection into the locking surface are different positions. If the locking projection and the retaining projection bite into the locking surface at the same position, the projection that is locked later weakly bites when the front retainer is displaced between the partial locking position and the full locking position. Therefore, a rattling preventing function may be reduced. However, the biting position of the locking projection and the biting position of the retaining projection are different. Thus the locking projection and the retaining projection reliably bite into the locking surface, and rattling is prevented reliably at both the partial locking position and the full locking position.

DETAILED DESCRIPTION

Figure 1:
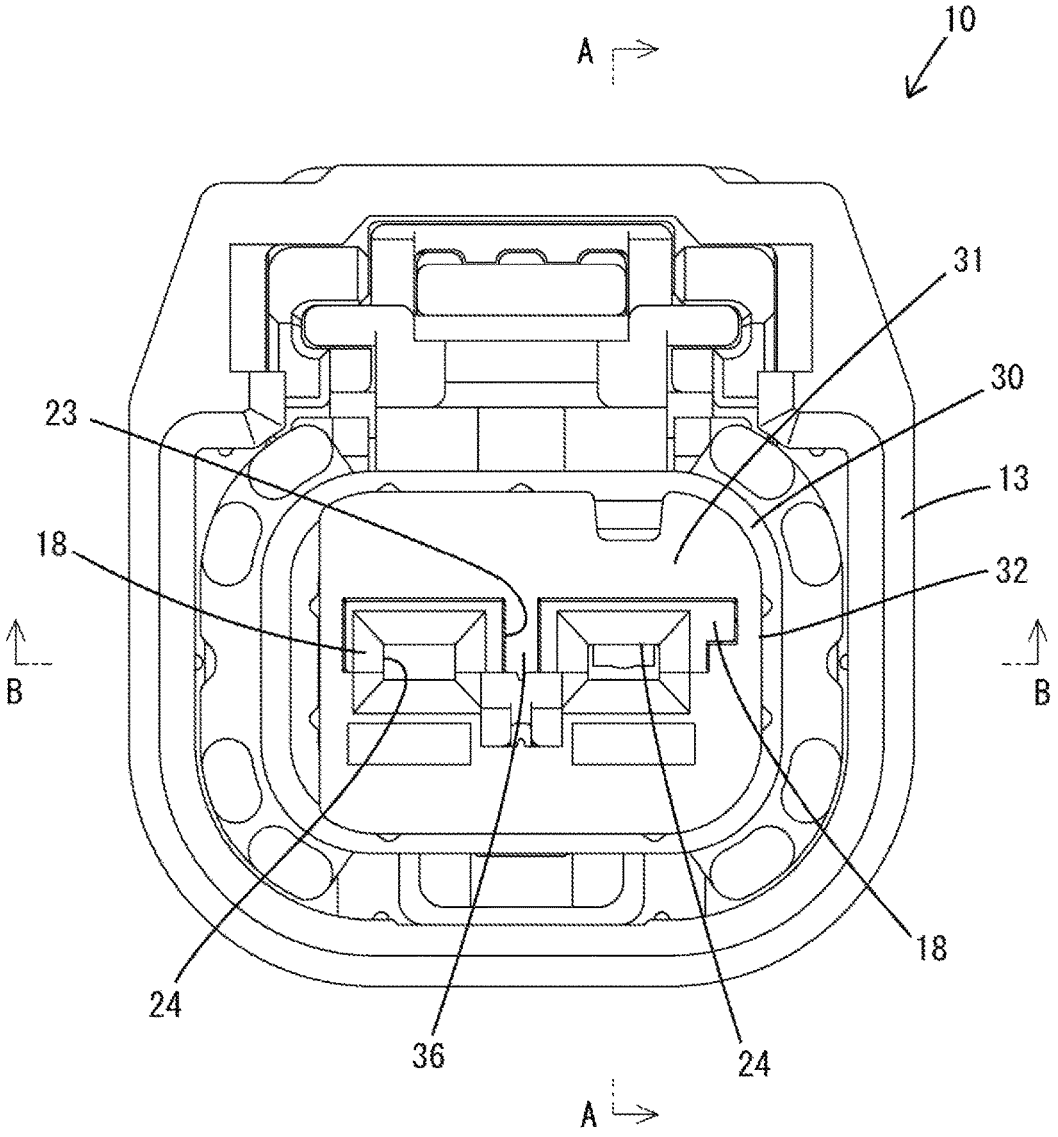
FIG. 1 is a front view of a connector of one embodiment.
Figure 2:
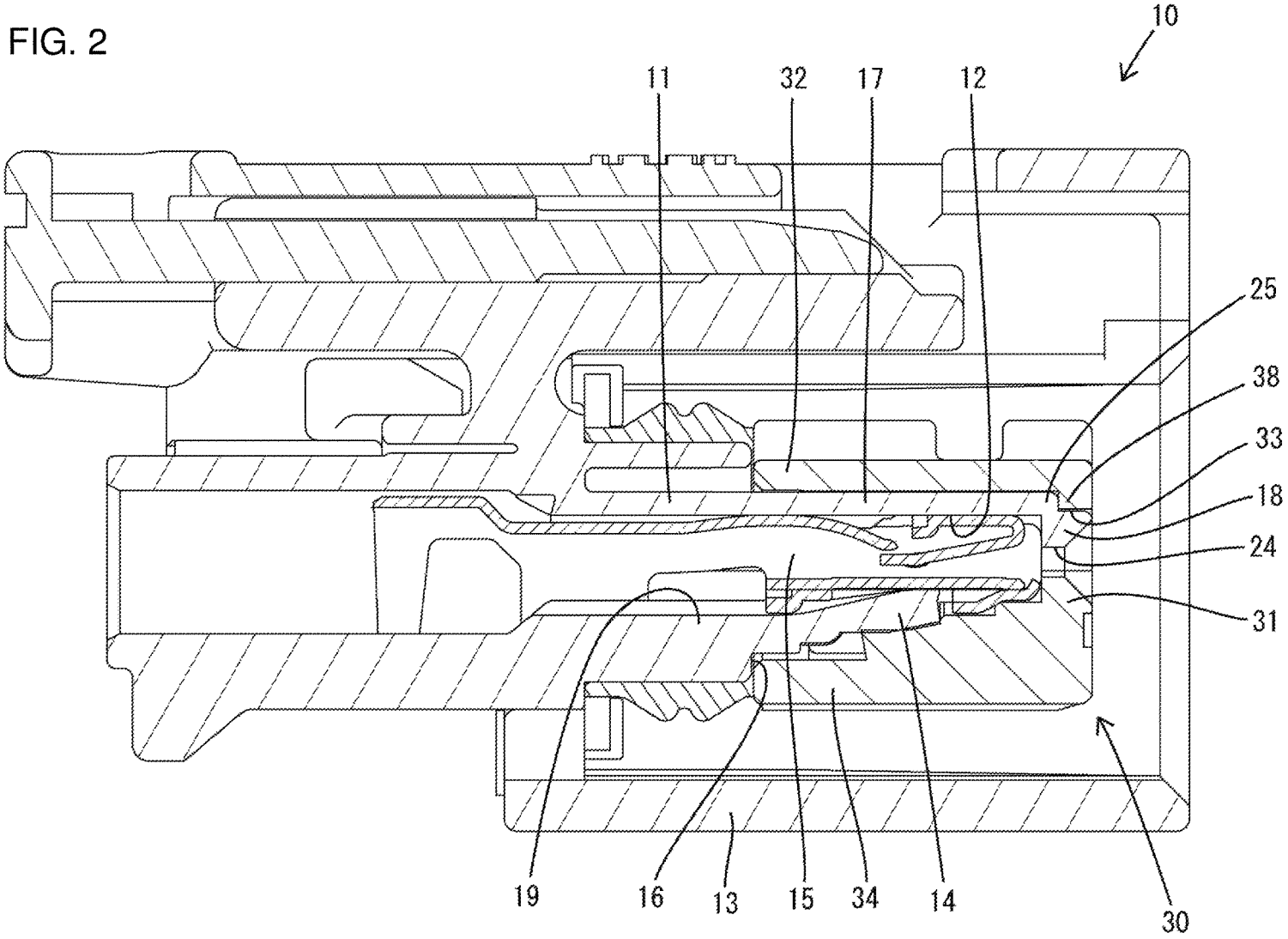
FIG. 2 is a section along A-A of FIG. 1.
Figure 3:
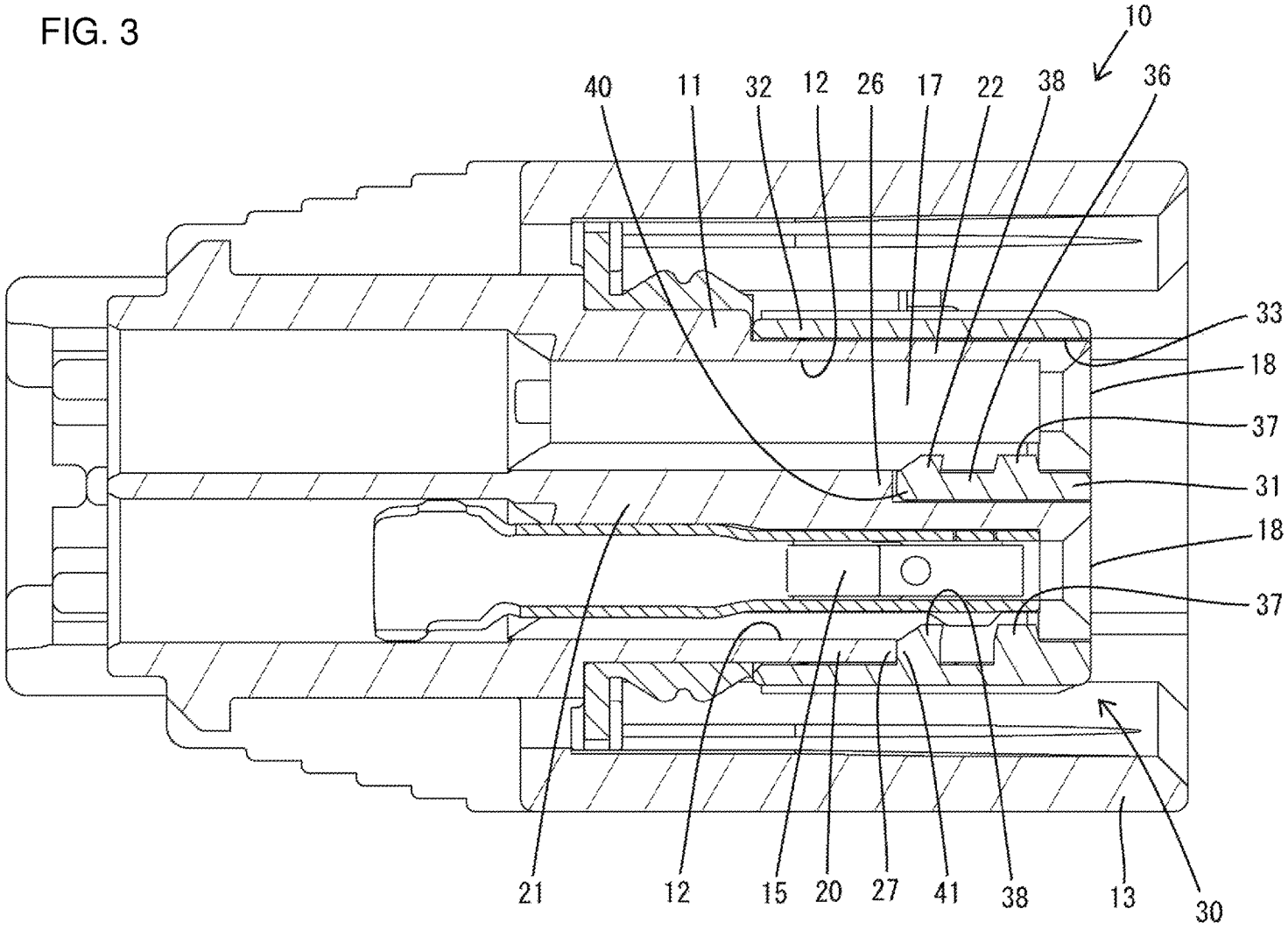
FIG. 3 is a section along B-B of FIG. 1.
Figure 4:
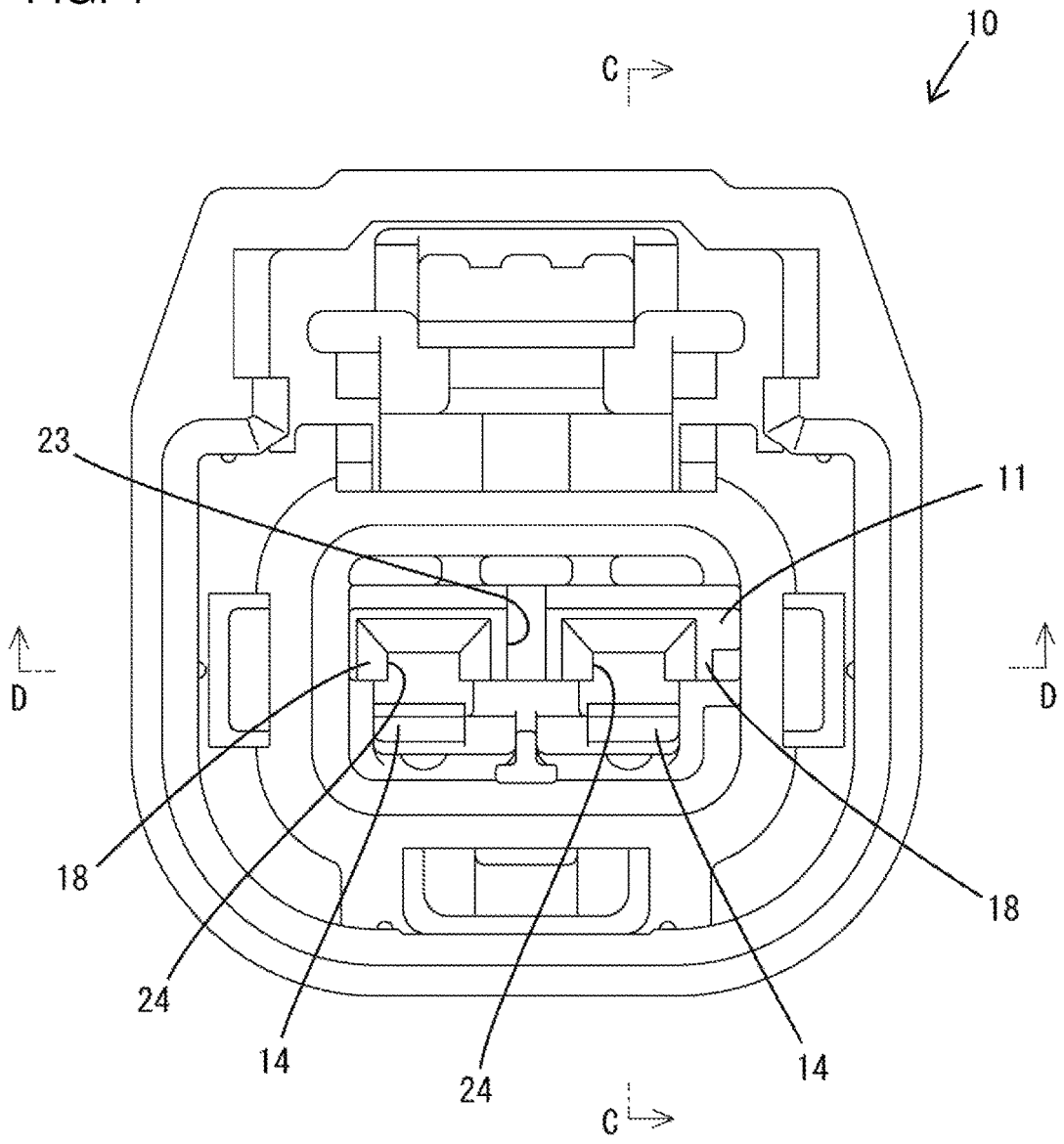
FIG. 4 is a front view of a housing.
Figure 5:
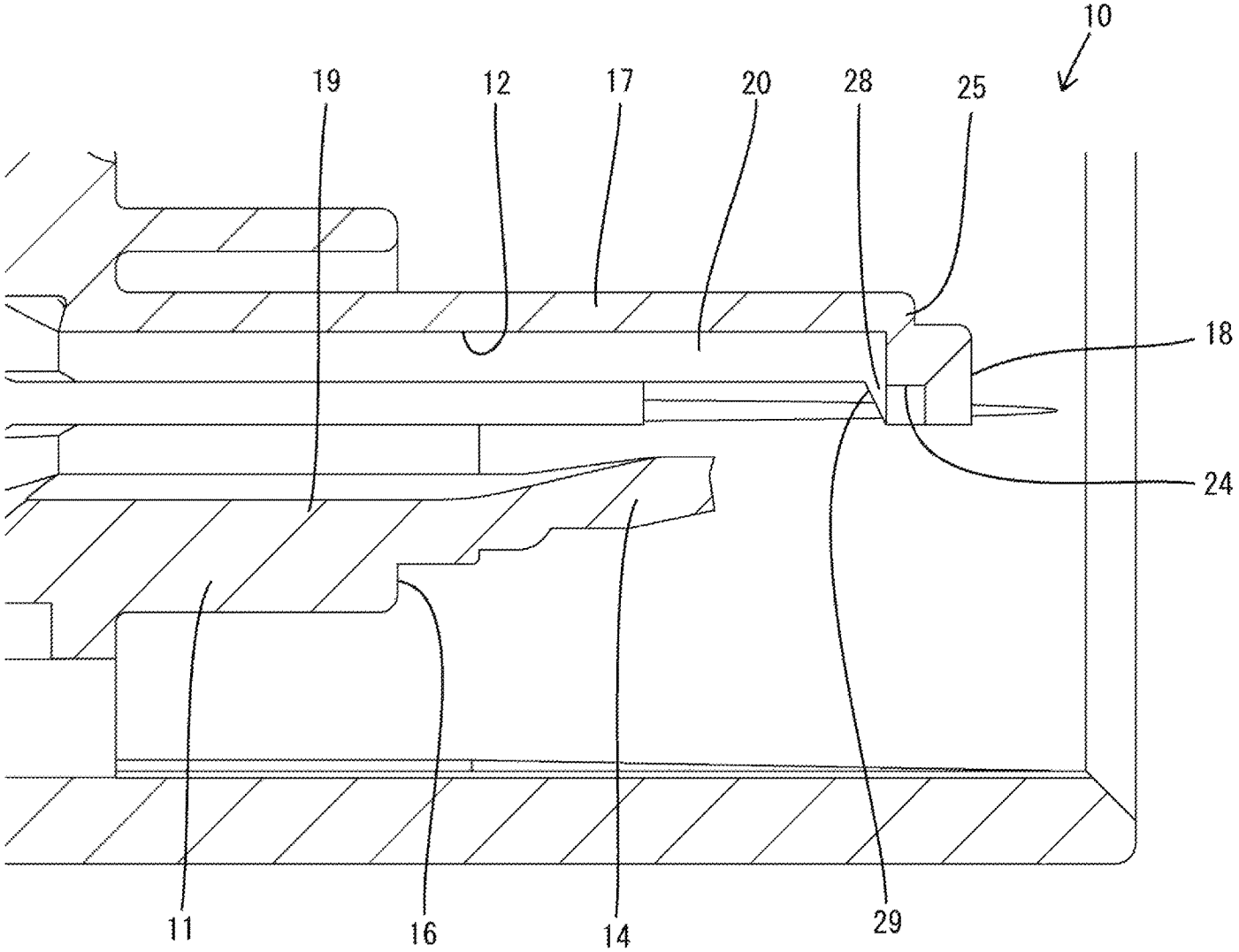
FIG. 5 is a partial enlarged section along C-C of FIG. 4.
Figure 6:
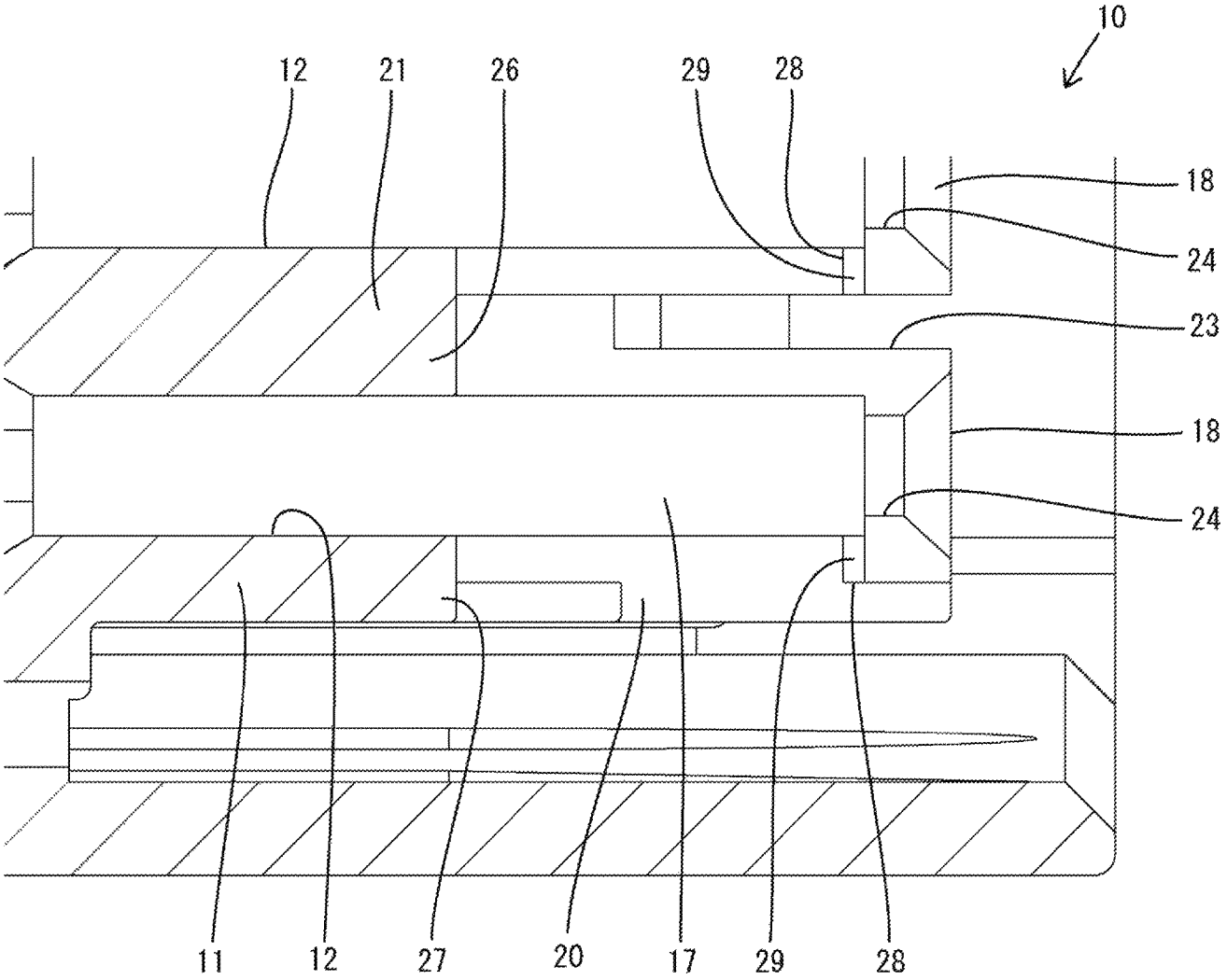
FIG. 6 is a partial enlarged section along D-D of FIG. 4.
Figure 7:
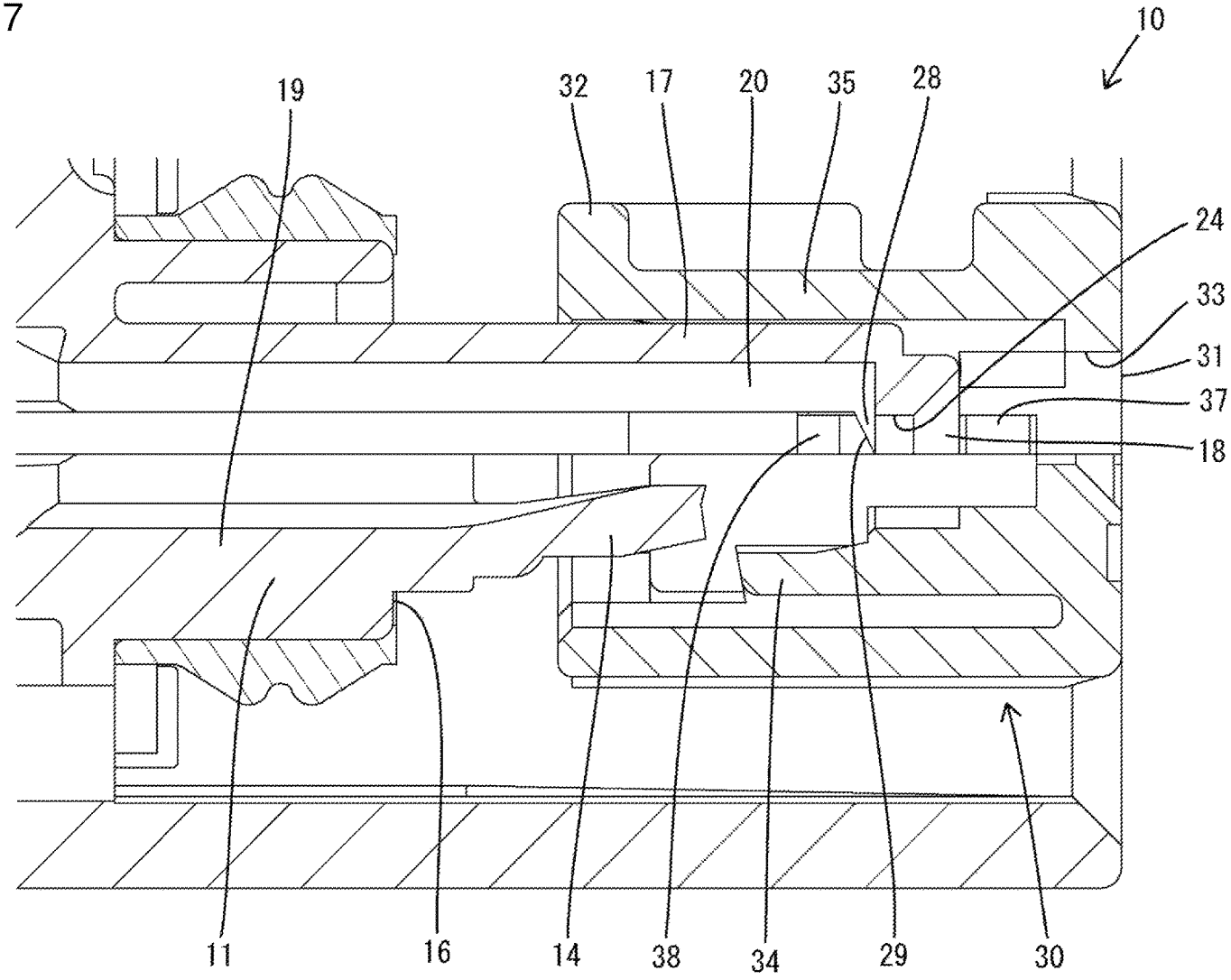
FIG. 7 is a partial enlarged section along C-C showing a state where a front retainer is held at a partial locking position.
Figure 8:
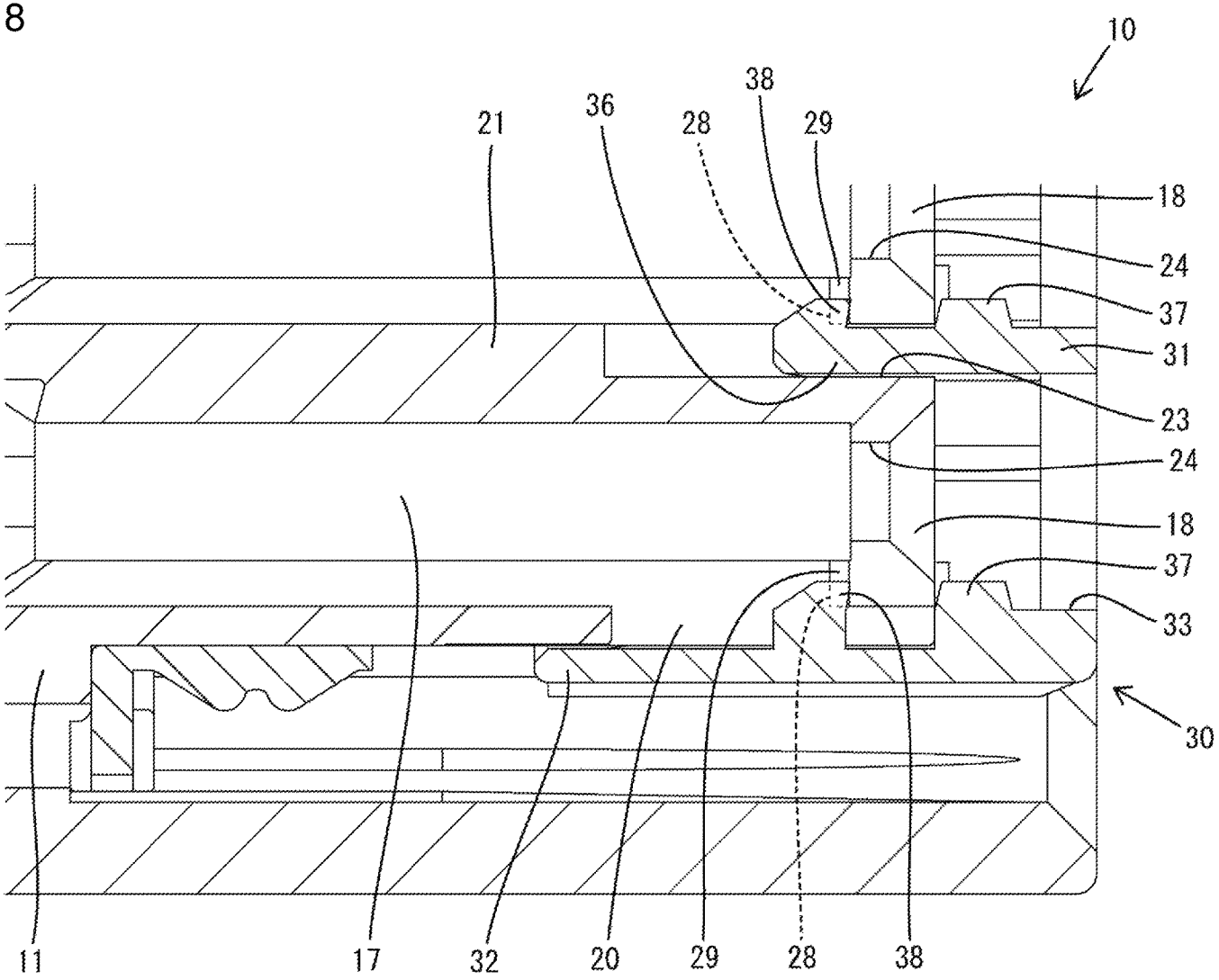
FIG. 8 is a partial enlarged section along D-D showing the state where the front retainer is held at the partial locking position.
Figure 9:
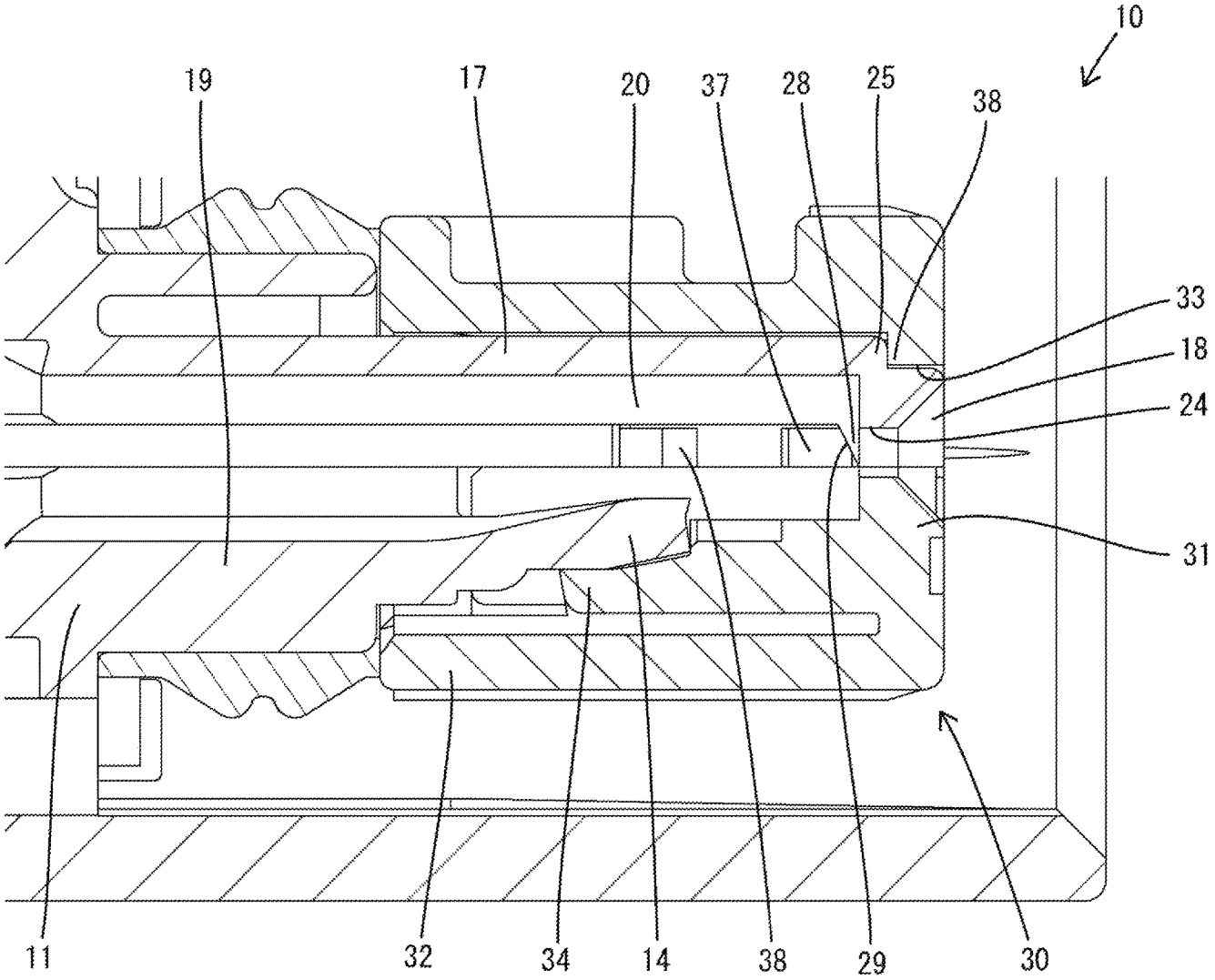
FIG. 9 is a partial enlarged section along C-C showing a state where the front retainer is held at a full locking position.
Figure 10:
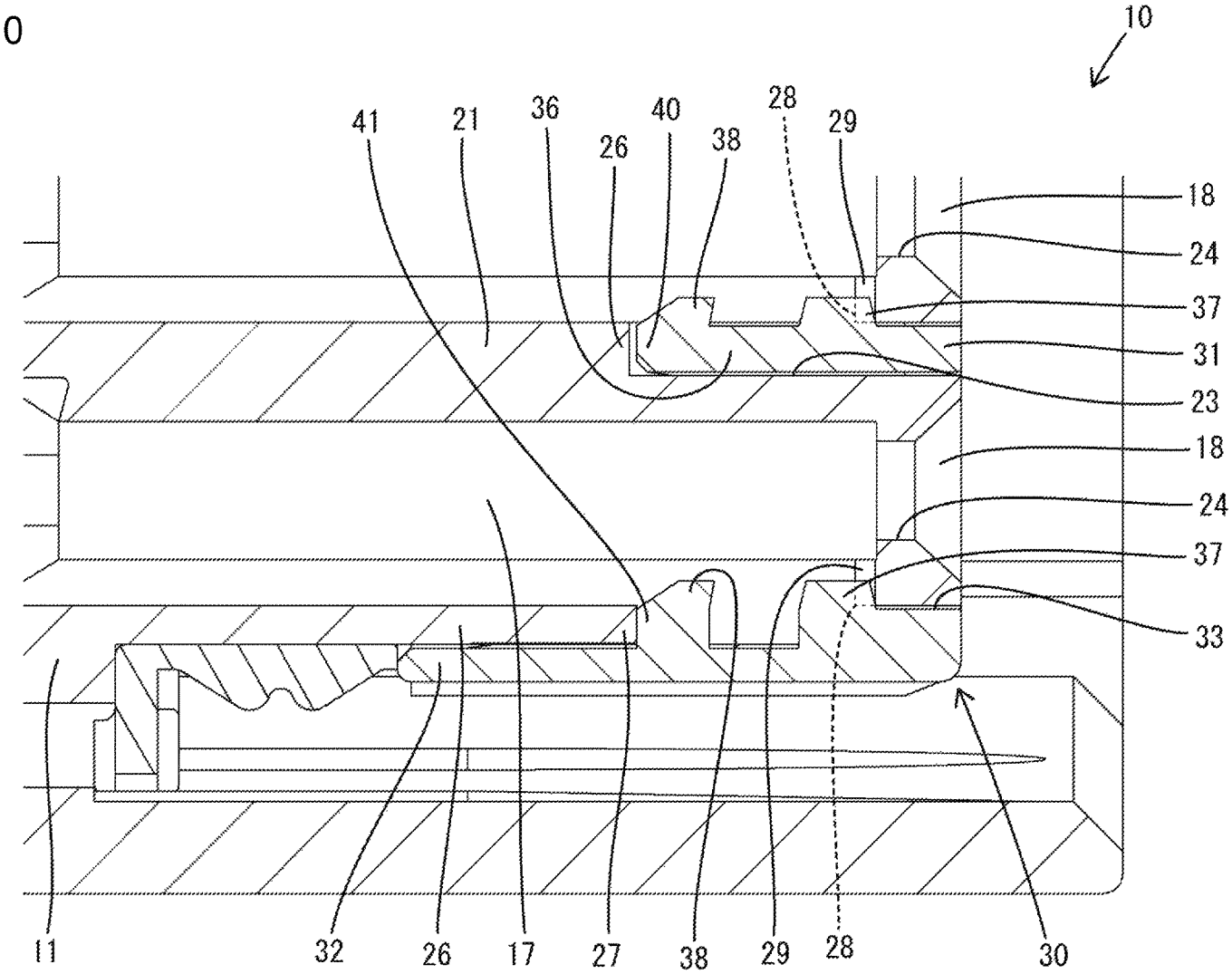
FIG. 10 is a partial enlarged section along D-D showing the state where the front retainer is held at the partial locking position.
Figure 11:
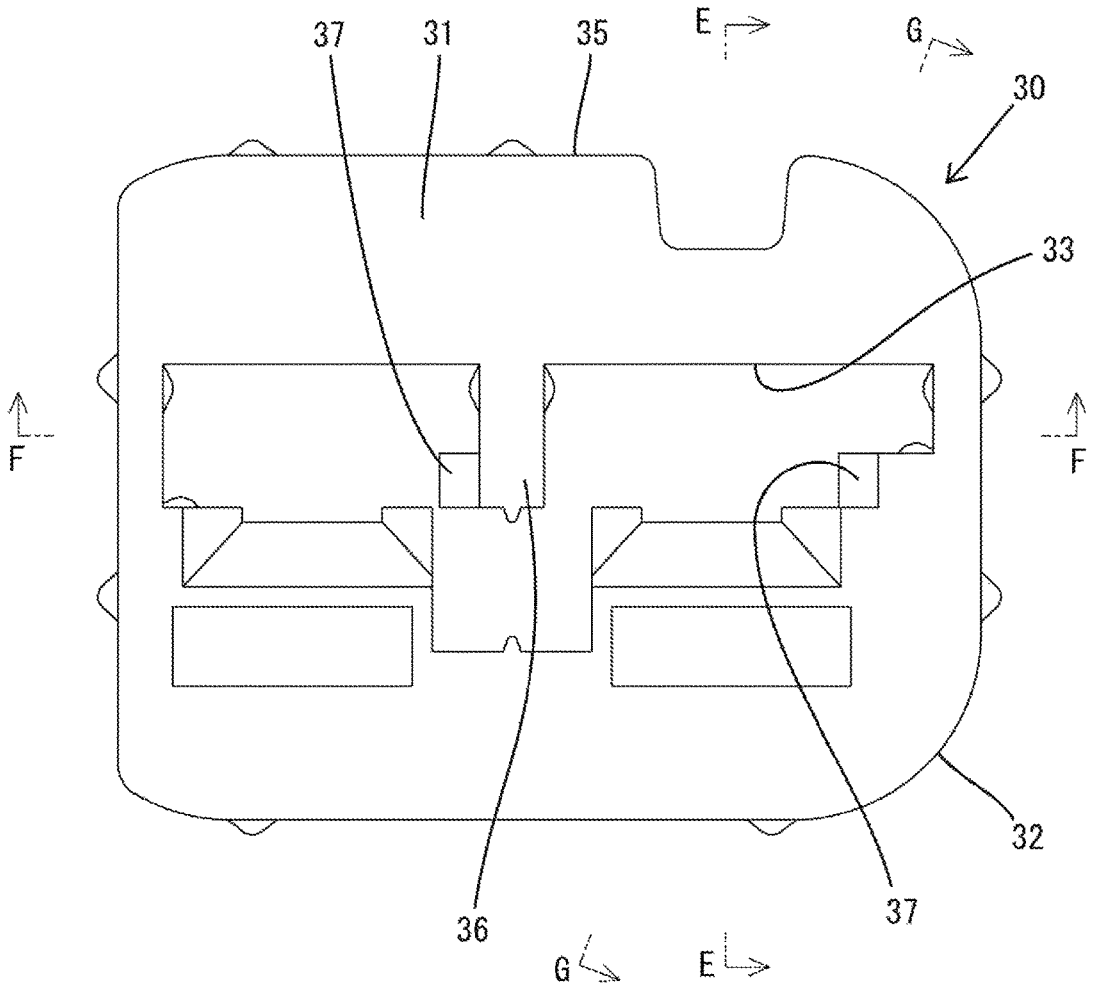
FIG. 11 is a front view of the front retainer.
Figure 12:
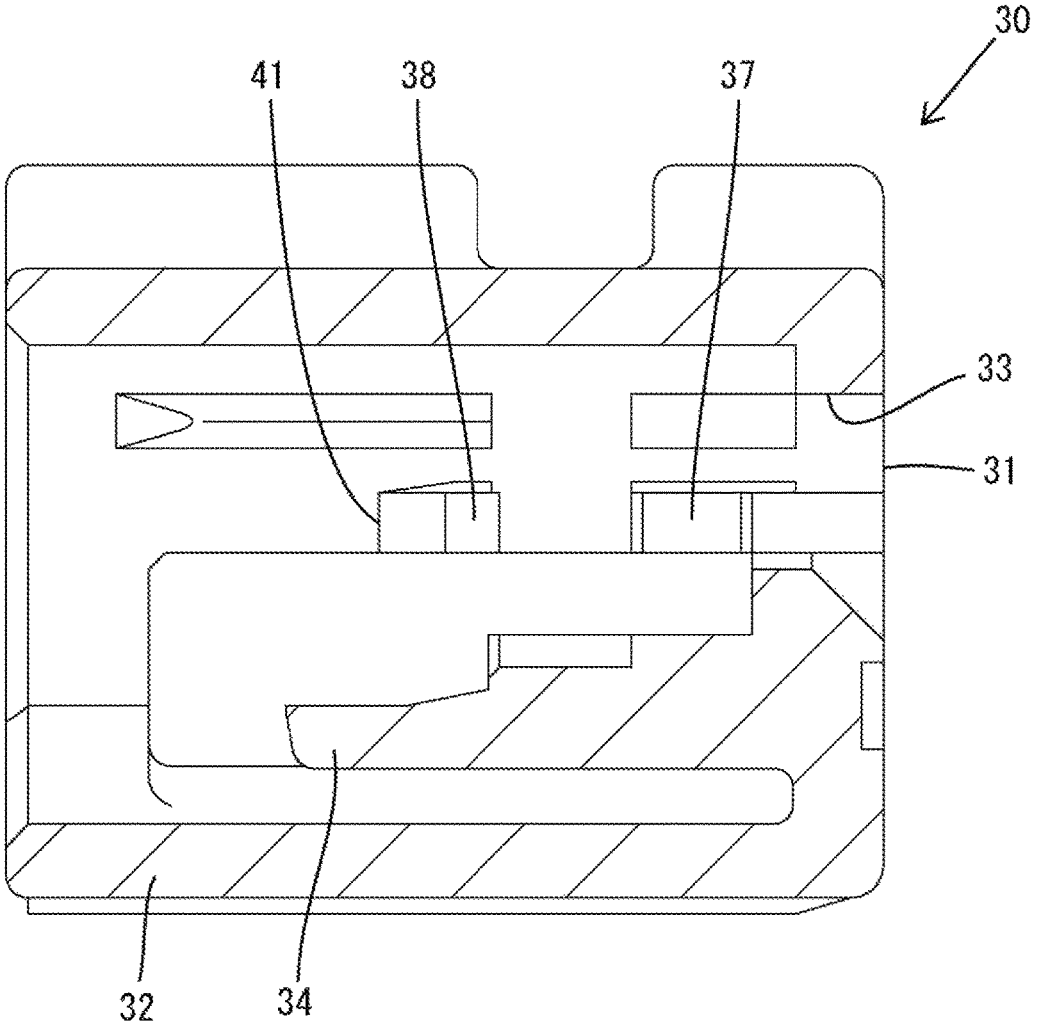
FIG. 12 is a section along E-E of FIG. 11.

An embodiment of the invention is described with reference to FIGS. 1 to 15. Note that, in the following description, a right side in FIGS. 2, 3, 5 to 10 and 12 to 14 is defined as a front side concerning a front-rear direction. Upper and lower sides shown in FIGS. 1, 2, 4, 5, 7, 9, 11 and 12 are defined as upper and lower sides concerning a vertical direction. A lower side in FIGS. 3, 6, 8, 10 and 13 is a right side concerning a lateral direction.

<Overall Configuration of Connector>

A connector of this embodiment includes a housing 10 made of synthetic resin, terminal fittings 15 made of metal and a front retainer 30 made of synthetic resin. The housing 10 is a single member made of polyamide resin (PA) and includes a terminal accommodating portion 11 having left and right terminal accommodation chambers 12 and a receptacle 13 surrounding the terminal accommodating portion 11. Each terminal accommodation chamber 12 has a forwardly cantilevered locking lance 14. The terminal fitting 15 is inserted into each terminal accommodation chamber 12 from behind the housing 10. A wire (not shown) is connected to a rear end part of the terminal fitting 15 by crimping and is drawn rearwardly out of the housing 10.

The front retainer 30 is fit to a front part of the terminal accommodating portion 11 from the front of the housing 10. The front retainer 30 is movable with respect to the housing 10 in directions parallel to the front-rear direction between a partial locking position (see FIGS. 7 and 8) and a full locking position (see FIGS. 2, 3, 9 and 10) behind the partial locking position. The front retainer 30 is a single member made of glass-filled polybutylene terephthalate (PBT) and having both a function of retaining the terminal fittings 15 and a function of detecting an inserted state of the terminal fittings 15.

The inserting and withdrawing operations of the terminal fittings 15 into and from the terminal accommodation chambers 12 are allowed when the front retainer 30 is at the partial locking position. The locking lance 14 interferes with the terminal fitting 15 as the terminal fitting 15 is inserted into the terminal accommodation chamber 12. As a result, the locking lance 14 deforms resiliently to retract from the terminal accommodation chamber 12 and to enter a deflection space 16 that is open in the front and bottom of the terminal accommodating portion 11. The locking lance 14 resiliently returns when the terminal fitting 15 is inserted to a proper position into the terminal accommodation chamber 12, and thereby locks and retains the terminal fitting 15.

The front retainer 30 is pushed from the partial locking position to the full locking position after the terminal fittings 15 are inserted into the terminal accommodation chambers 12. At this time, the locking lances 14 resiliently return and exit from the deflection spaces 16 if the terminal fittings 15 are inserted properly. Thus, detecting portions 34 of the front retainer 30 enter the deflection spaces 16 and restrict resilient deformation of the locking lances 14 away from the terminal fittings 15, thereby reliably retaining the terminal fittings 15 by a double locking action of the locking lances 14 and the front retainer 30.

The locking lance 14 is left in the deflection space 16 if a terminal fitting 15 has not reached a proper insertion position. Thus, the detecting portion 34 butts against the locking lance 14 immediately after starting to push the front retainer 30 from the partial locking position to the full locking position so that the front retainer 30 cannot be pushed to the full locking position. Therefore, whether the terminal fittings 15 are in a properly inserted state or an incompletely inserted state can be detected based on whether or not the front retainer 30 can be pushed to the full locking position.

<Terminal Accommodating Portion 11>

The terminal accommodating portion 11 has the right and left terminal accommodating chambers. The right terminal accommodation chamber 12 is defined by a base 17 extending in the front-rear direction along the inserting direction of the terminal fitting 15, a front wall 18 projecting down substantially at a right angle from a front end of the base portion 17, a lower wall 19 disposed to face the base 17, a right side wall 20 projecting down from a right side of the base 17 and a separation wall 21 projecting down from a left side of the base 17. The left terminal accommodation chamber 12 is defined by a base 17 extending in the front-rear direction along the inserting direction of the terminal fitting 15, a lower wall 19 disposed to face the base 17, the separation wall 21 common to the right terminal accommodation chamber 12, and a left side wall 22 projecting down from a left side of the base 17.

The lower wall 19 of the right terminal accommodation chamber 12 and the lower wall 19 of the left terminal accommodation chamber 12 are linked laterally adjacent to each other. The front end of the lower wall 19 is located behind the front wall 18 of the terminal accommodation chamber 12, and the locking lance 14 is cantilevered forward from the front end of the lower wall 19. Areas of the right side wall 20, the separation wall 21 and the left side wall 22 in front of the rear end of the locking lance 14 have substantially lower halves cut off. A slit 23 is formed in a laterally central part of the separation wall 21 and extends in the front-rear direction. A formation area of the slit 23 is a range from the front end of the terminal accommodating portion 11 to the rear end of the locking lance 14. The two left and right bases 17 are independently cantilevered forward by the slit 23.

The terminal accommodating portion 11 includes left and right front walls 18 projecting down from the front ends of the respective bases 17. Both left and right ends of the rear surface of the right front wall 18 are linked integrally at a substantially right angle to the front end of the separation wall 21 and the front end of the right side wall 20. Both left and right end parts of the rear surface of the left front wall 18 are linked integrally at a substantially right angle to the front end of the right side wall 20 and the front end of the separation wall 21. A projecting lower end edge of each front wall 18 has a laterally central part cut upwardly to form a rectangular tab insertion recess 24. The tab insertion recess 24 allows a tab of a mating terminal (not shown) to be inserted into the terminal accommodation chamber 12 from the front of the housing 10.

A first front stop 25 is formed on an upper edge part linking a front part of the base 17 and an upper part of the front wall 18. The separation wall 21 is formed with a second front stop 26 located behind the front wall 18. The right side wall 20 is formed with a third front stop 27 located behind the front wall 18. The first, second and third front stops 25, 26 and 27 restrict a relative rearward displacement of the front retainer 30 with respect to the housing 10 when the front retainer 30 is locked fully to the housing 10.

<Lock 28>

A lower end of the front wall 18 is at a position lower than the lower ends of the right side wall 20, the separation wall 21 and the left side wall 22. Specifically, in the front of the terminal accommodating portion 11, a downward projecting dimension of the front wall 18 from the base 17 is larger than those of the right side wall 20, the separation wall 21 and the left side wall 22. Left and right locks 28 are formed integrally to the terminal accommodating portion 11 utilizing these dimensional differences.

The right lock 28 projects rearward from a right end of the rear surface of the front wall 18 and is linked integrally to the lower end surface of the right side wall 20. In other words, the right lock 28 is linked to a front end part of the rear side edge of the base 17 via a front end part of the right side wall 20. On the other hand, the left lock 28 projects rearward from a position slightly to the right of a lateral center of the front wall 18 and is linked integrally to the lower end surface of a left part of the separation wall 21 divided by the slit 23. In other words, the left lock 28 is linked to a substantially central front end part of the base 17 in the lateral direction via a front end part of the separation wall 21.

Each lock 28 has a right triangular shape in a side view (in a direction intersecting both the inserting direction of the terminal fitting 15 into the terminal accommodation chamber 12 and a resilient displacement direction of the locking lance 14). For the right lock 28, two sides of the right triangular shape at a right angle to each other are linked integrally to the front wall 18 and the right side wall 20. For the left lock 28, two sides of the right triangular shape at a right angle to each other are linked integrally to the front wall 18 and the separation wall 21. The rear surface of each locks 28, which is a hypotenuse of the right triangle, serves as a locking surface 29, and is a flat surface inclined with respect to both the inserting direction of the terminal fitting 15 into the terminal accommodation chamber 12 and an assembling direction of the front retainer 30 with the housing 10.

<Front Retainer>

The front retainer 30 is a single component including a front panel 31 disposed on the front end of the front retainer 30 and a substantially rectangular tubular portion 32 extending rearward from the outer periphery of the front panel 31. A fitting hole 33 penetrates the front panel 31 to allow a front part (front wall 18) of the terminal accommodation chamber 12 to fit therein. The detecting portions 34 cantilevered rearward from the rear surface of the front panel 31. A supporting plate 36 extends down substantially at a right angle from an upper plate 35 constituting the tubular portion 32. The supporting plate 36 is a flat plate having a plate thickness direction aligned with the lateral direction. With the front retainer 30 mounted on the housing 10, the supporting plate 36 is fit into the slit 23 of the separation wall 21 of the housing 10. A formation area of the supporting plate 36 in the front-rear direction is a predetermined length range extending rearward from the front end of the front retainer 30.

Figure 13:
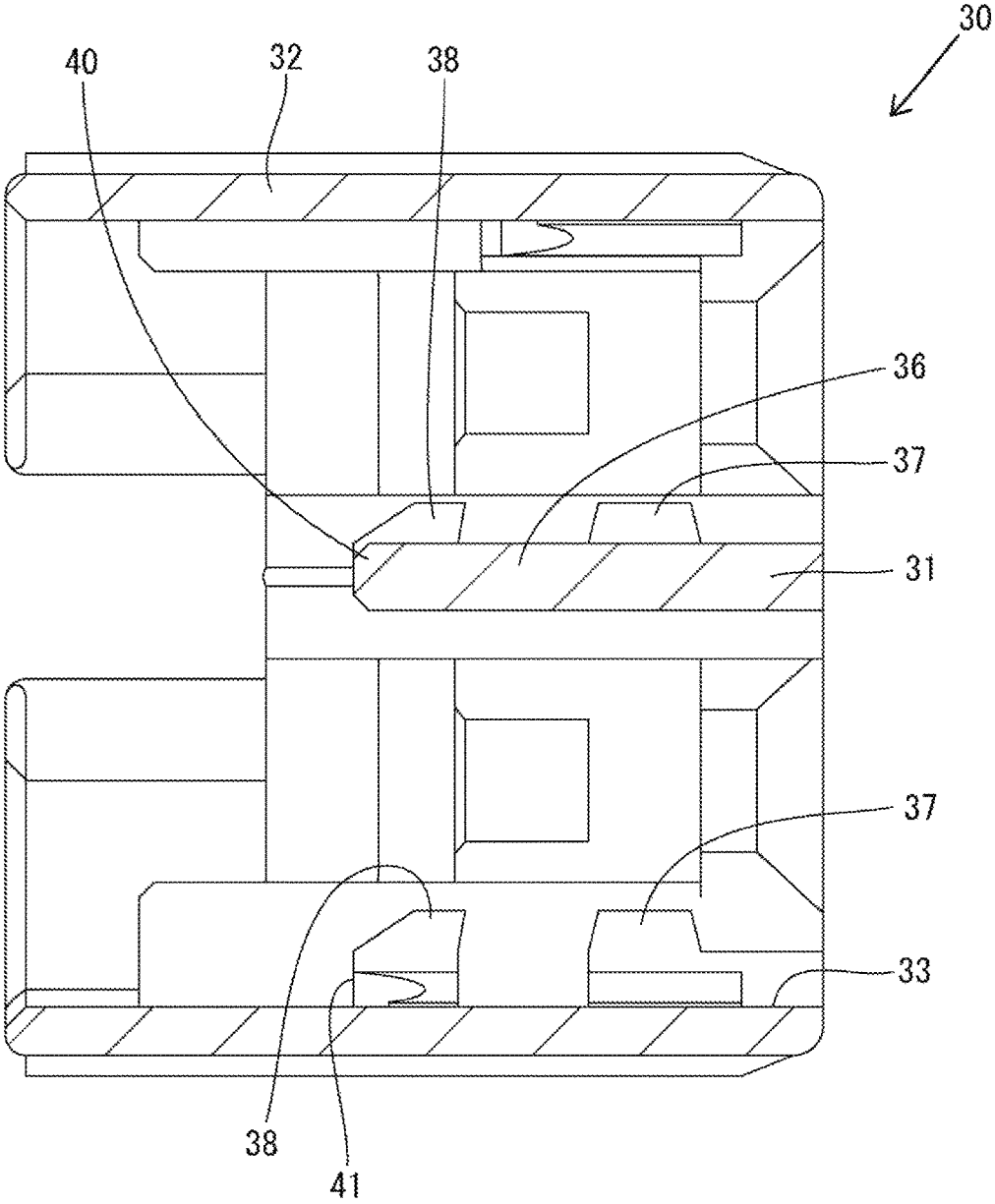
FIG. 13 is a section along F-F of FIG. 11.
Figure 14:
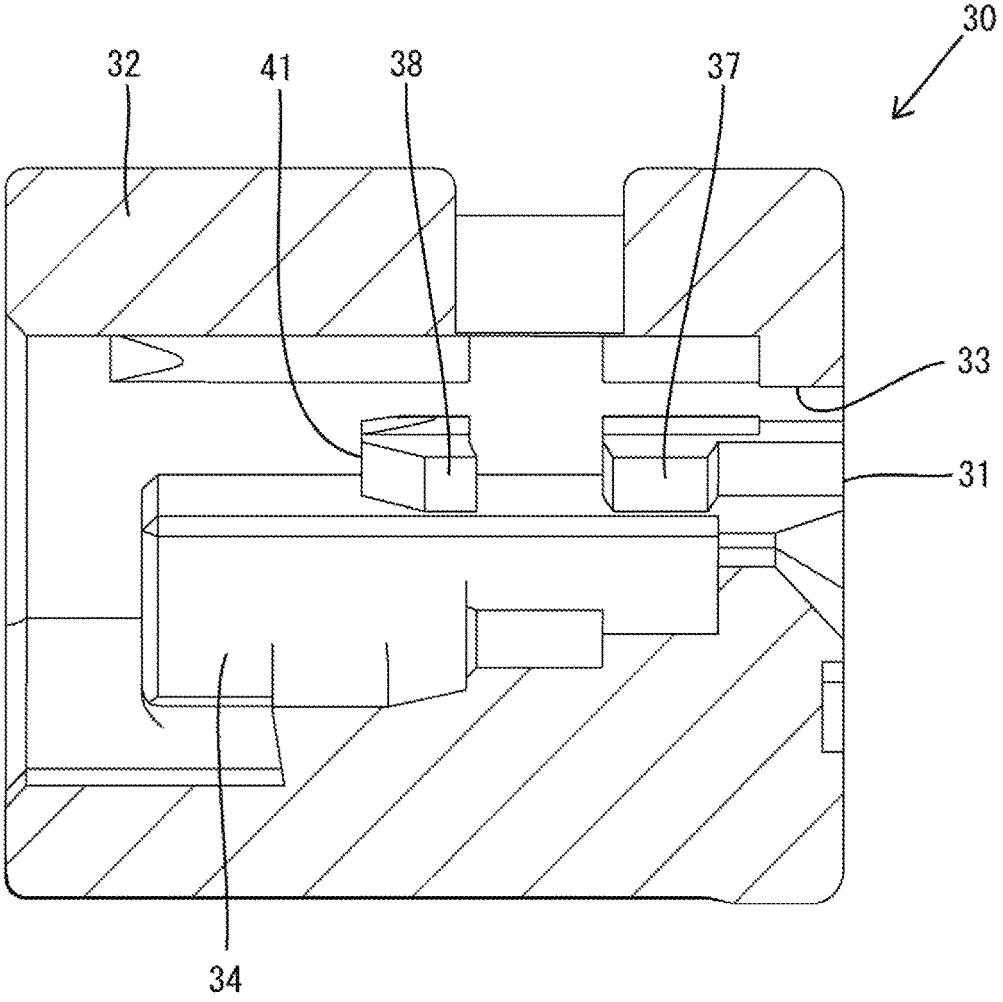
FIG. 14 is a section along G-G of FIG. 11.

A locking projection 37 and a retaining projection 38 are formed on the left side surface of the supporting plate 36. The locking projection 37 is slightly behind the front end of the front retainer 30. As shown in FIGS. 13 and 14, the locking projection 37 has an isosceles trapezoidal shape in a plan view whose length in the front-rear direction becomes shorter toward a left side away from the supporting plate portion 36. The front and rear surfaces of the locking projection 37 are inclined approximately at a right angle with respect to the assembling direction of the front retainer 30 with the housing 10 (moving direction between the partial locking position and the full locking position).

The retaining projection 38 is behind the locking projection 37, i.e. on a rear part of the supporting plate 36. The retaining projection 38 has a non-isosceles trapezoidal shape in a plan view whose length in the front-rear direction becomes shorter toward the left side away from the supporting plate 36. The front surface (surface facing the rear surface of the locking projection 37 in the front-rear direction) of the retaining projection 38 is inclined to the assembling direction of the front retainer 30 and at an acute angle to the left side surface of the supporting plate 36. The rear surface of the retaining projection 38 is inclined with respect to the assembling direction of the front retainer 30 and at an obtuse angle to the left side surface of the supporting plate 36.

Similar to the supporting plate 36, a locking projection 37 and a retaining projection 38 also are formed on the left side surface of a right side plate of the tubular portion 32 (inner surface of the tubular portion 32). The position in the front-rear direction and the planar shape of the locking projection 37 on the right side plate are the same as those of the locking projection 37 of the supporting plate 36. The position in the front-rear direction and the planar shape of the retaining projection 38 on the right side plate are the same as those of the retaining projection 38 of the supporting plate 36.

A first butting portion 39 is formed in an area of the rear surface of the front panel 31 extending along an opening upper edge of the fitting hole 33. A second butting portion 40 is formed on a rear end part of the supporting plate 36. A third butting portion 41 is formed on a base end of the retaining projection 38 on the right side plate. When the front retainer 30 is at the full locking position, the first, second and third butting portions 39, 40 and 41 are respectively in contact with the first, second and third front stops 25, 26 and 27 from the front.

<Functions and Effects of Embodiment>

Figure 15:
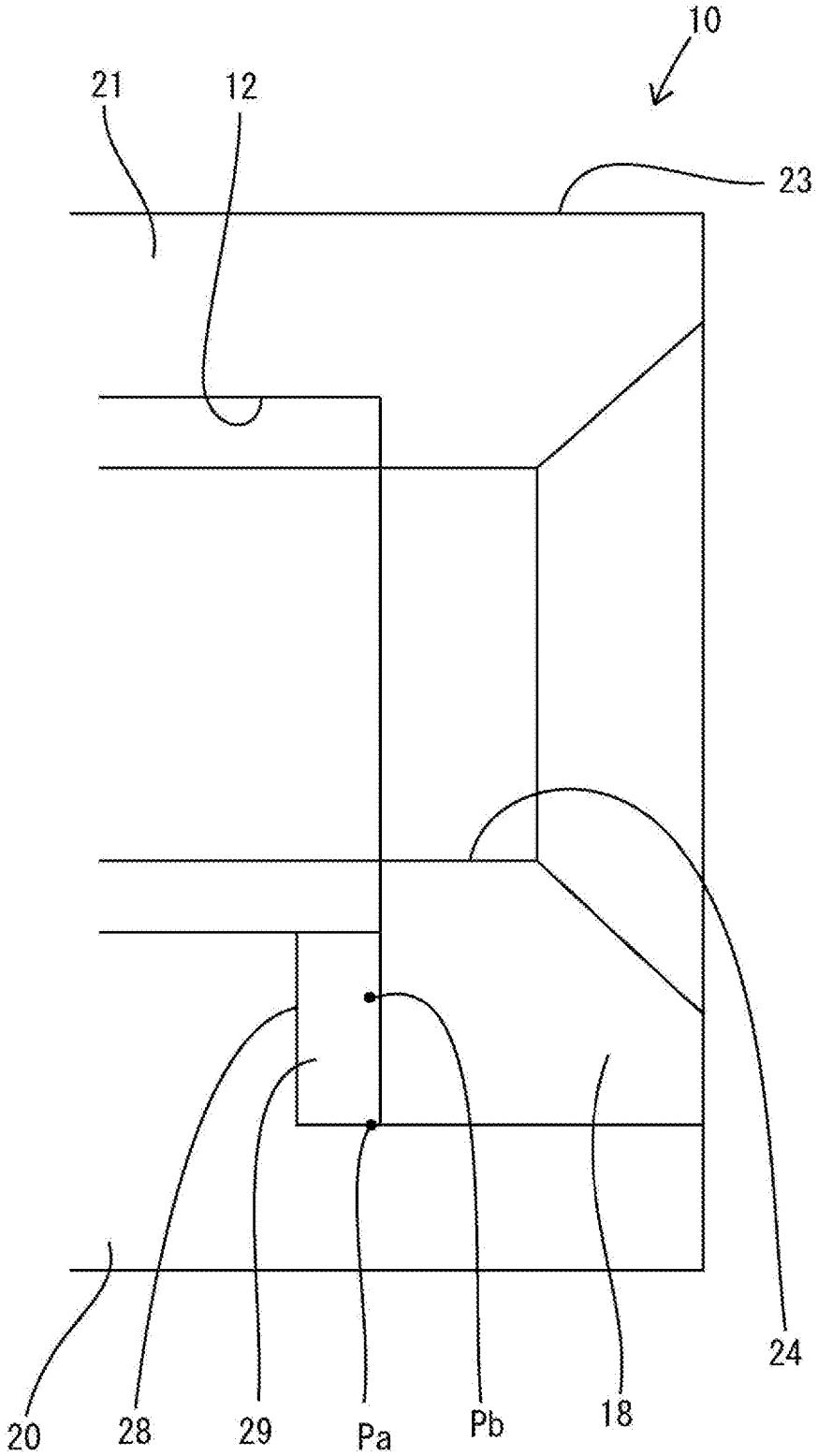
FIG. 15 is a partial enlarged section along D-D showing a biting position of a locking projection into a locking surface and a biting position of a retaining projection into the locking surface.

The rear surfaces of the left and right locking projections 37 are locked to the front surfaces of the front walls 18 from the front with the front retainer 30 held at the partial locking position so that a relative rearward displacement of the front retainer 30 with respect to the housing 10 is restricted. Further, the front surfaces of the left and right retaining projections 38 are locked respectively to bite into the locking surfaces 29 from behind to restrict a forward displacement of the front retainer 30 with respect to the housing 10. As shown in FIG. 15, a biting position Pa of the front surface of the retaining projection 38 into the locking surface 29 is a relatively upper position in the vertical direction in a substantially central part of the locking surface 29 in the lateral direction.

If the front panel 31 of the front retainer 30 at the partial locking position is pushed from the front, the front retainer 30 is slid to the full locking position. In the process of pushing the front retainer 30 rearward, the locking projections 37 interfere with the right parts of the front walls 18 so that the tubular portion 32 is deformed resiliently to expand laterally, the right portion is displaced relatively rightward away from the right front wall 18 and the supporting plate 36 is displaced relatively rightward away from the left front wall 18.

When the front retainer 30 reaches the full locking position, the first to third butting portions 39 to 41 contact the first to third front stop portions 25 to 27 from front, thereby restricting a relative rearward displacement of the front retainer 30 with respect to the housing 10. Further, as the shape of the tubular portion 32 is restored resiliently, the front surfaces of the left and right locking projections 37 are locked individually to bite into the locking surfaces 29 from behind, thereby restricting a relative forward displacement of the front retainer 30 with respect to the housing 10. The biting position Pa of the locking surface 29 where the front surface of the locking projection 37 bites is a vertically relatively upper position on a right end part of the locking surface 29. That is, the biting position Pa of the locking projection 37 into the locking surface 29 and a biting position Pb of the retaining projection 38 into the locking surface 29 are substantially at the same height in the vertical direction, but different in the lateral direction.

The connector of this embodiment includes the housing 10 formed with the terminal accommodating portion 11, the terminal fittings 15 to be inserted into the terminal accommodating portion 11 from behind the housing 10 and the front retainer 30 to be assembled with the front end part of the housing 10 from front. The terminal accommodating portion 10 is formed with the locking surfaces 29 configured to hold the front retainer 30 and the housing 10 in an assembled state by having the locking projections 37 of the front retainer 30 locked thereto from the front. The locking surfaces 29 are inclined with respect to the assembling direction of the front retainer 30 with the housing 10.

With the front retainer 30 and the housing 10 assembled, a positional relationship of the locking surfaces 29 and the locking projections 37 in the front-rear direction may vary due to dimensional and assembly tolerances. However, the locking surfaces 29 are inclined with respect to the assembling direction of the front retainer 30 in the connector. Thus, the locking surfaces 29 and the locking projections 37 remain locked and ratting is prevented.

The terminal accommodating portion 11 includes the bases 17 extending along the inserting direction of the terminal fittings 15, the front walls 18 projecting orthogonally from the front ends of the bases 17, the tab insertion recesses 24 formed by recessing the projecting ends of the front walls 18, and the locks 28 projecting rearward from the sides of the front walls 18 and linked to the bases 17 via the right side wall 20 or the separation wall 21. The locking surfaces 29 are formed on the rear end surfaces of the locks 28.

The front walls 18 are formed with the tab insertion recesses 24 and may be deformed to incline toward the tab insertion recesses 24 when pressed by the locking projections 37 in the process of assembling the front retainer 30 with the housing 10. However, the locks 28 are linked to the bases 17 via the right side wall 20 or the separation wall 21 and project from the sides of the front walls 18. Thus, the front walls 18 are not inclined toward the tab insertion recesses 24 even if pressed by the locking projections 37.

Further, the front retainer 30 is formed with the first to third butting portions 39 to 41 and these first to third butting portions 39 to 41 are individually in contact with the first to third front stops 25 to 27 of the housing 10 when the front retainer 30 is assembled with the housing 10 and held at the full locking position. With the first to third butting portions 39 to 41 butting against the first to third front stops 25 to 27, the locking projections 37 are locked to bite into the locking surfaces 29. This configuration reliably prevents rattling between the front retainer 30 and the housing 10.

Further, the front retainer 30 is displaceable in the front-rear direction between the partial locking position where the front retainer 30 is mounted on the housing 10 to allow the insertion and withdrawal of the terminal fittings 15 into and from the terminal accommodating portion 11 and the full locking position where the front retainer 30 is mounted on the housing 10 to retain the terminal fittings 15 inserted into the terminal accommodating portion 11. The front retainer 30 is formed with the retaining projections 38 that engage the locking surfaces 29 to restrict the separation of the front retainer 30 at the partial locking position from the housing 10. This configuration prevents rattling between the front retainer 30 and the housing 10 even with the front retainer 30 held at the partial locking position.

Further, the locking projections 37 are locked to the housing 10 from the front, and the retaining projections 38 are locked to bite into the locking surfaces 29 when the front retainer 30 is held at the partial locking position. This configuration reliably prevents rattling between the front retainer 30 and the housing 10 with the front retainer 30 held at the partial locking position.

Further, the locking projections 37 are locked to bite into the locking surfaces 2 when the front retainer 30 is held at the full locking position 9. If the locking projections 37 and the retaining projections 38 bite into the locking surfaces 29 at the same positions, the projections that are later locked bite weakly when the front retainer 30 is displaced between the partial locking position and the full locking position. Therefore a rattling preventing function may be reduced. However, the biting position Pa of the locking projection 37 and the biting position Pb of the retaining projection 38 are different positions in this embodiment. Thus, both the locking projection 37 and the retaining projection 38 reliably bite into the locking surface 29. In this way, rattling between the housing 10 and the front retainer 30 can be reliably prevented at both the partial locking position and the full locking position.

The invention is not limited to the above described and illustrated embodiment. For example, the following embodiments also are included in the scope of the invention.

Although the side view shape of the locking portion is a right triangular shape having two sides at a right angle to each other linked to the front wall and the base in the above embodiment, the side view shape of the locking portion may be such that a locking surface obliquely faces a base without being linked to the base portion, a non-isosceles trapezoidal shape or the like.

Although the housing is made of polyamide resin (PA) in the above embodiment, the housing may be made of a material other than polyamide resin.

Although the front retainer is made of glass-filled polybutylene terephthalate (PBT) in the above embodiment, the front retainer may be made of a material other than glass-filled polybutylene terephthalate.

Although the locking projection is locked to bite into the locking surface in the above embodiment, the locking projection may be locked to the locking surface without biting into the locking surface.

Although the retaining projection is locked to bite into the locking surface in the above embodiment, the retaining projection may be locked to the locking surface without biting into the locking surface.

Although the biting position of the locking projection into the locking surface and the biting position of the retaining projection into the locking surface are different in the above embodiment, the biting position of the locking projection into the locking surface and the biting position of the retaining projection into the locking surface may be the same.

Although the front retainer is held at the partial locking position with respect to the housing in the above embodiment, the invention can be applied to connectors in which a front retainer is held only at a full locking position without being held at a partial locking position.

LIST OF REFERENCE SIGNS

10 . . . housing
11 . . . terminal accommodating portion
15 . . . terminal fitting
17 . . . base
18 . . . front wall
20 . . . right side wall
21 . . . separation wall
24 . . . tab insertion recess
28 . . . lock
29 . . . locking surface
30 . . . front retainer
37 . . . locking projection
38 . . . retaining projection
39 . . . first butting portion
40 . . . second butting portion
41 . . . third butting portion
Pa . . . biting position of locking projection
Pb . . . biting position of retaining projection

What is claimed is:

1. A connector, comprising:

a housing formed with a terminal accommodating portion extending in forward to backward directions, a lock formed at a front end of the terminal accommodating portion and having a rearwardly facing locking surface;

a terminal fitting to be inserted into the terminal accommodating portion from behind the housing; and a front retainer to be assembled with a front end part of the housing, and displaceable in a front-rear direction between a partial lock position where the front retainer is mounted on the housing to allow insertion and withdrawal of the terminal fitting in the terminal accommodating portion and a full locking position where the front retainer is mounted on the housing to retain the terminal fitting in the terminal accommodating portion, the front retainer having a front panel and a substantially tubular portion extending rearward from the front panel and configured to receive the terminal accommodating portion from behind, the tubular portion having an inner surface with a retaining projection and a locking projection projecting therefrom, the retaining projecting biting into the locking surface when the front retainer is at the partial lock position, and the locking projection being spaced forward from the retaining projection and biting into the locking surface when the front retainer is at the full locking position;

wherein the locking surface is inclined with respect to an assembling direction of the front retainer with the housing;

a front surface of the retaining projection is inclined with respect to the inner surface of the tubular portion to contact the locking surface at a first position, and a front surface of the locking projection is inclined with respect to the inner surface of the tubular portion to contact the locking surface at a second position aligned substantially vertically with the first position and spaced laterally from the first position.

2. The connector of claim 1, wherein:

the terminal accommodating portion includes:

a base extending along an inserting direction of the terminal fitting;

a front wall extending substantially at a right angle from a front end edge of the base;

a tab insertion recess formed by recessing a projecting end edge of the front wall; and the lock projects rearward from a side of the front wall and linked to the base via a wall portion.

3. The connector of claim 2, wherein:

the front retainer is formed with a butting portion, configured to be in contact with the housing from the front in a state assembled with the housing; and the locking projection is locked to bite into the locking surface with the butting portion butting against the housing.

4. The connector of claim 1, wherein the locking projection is locked to the housing from the front when the retaining projection is locked to bite into the locking surface with the front retainer held at the partial locking position.

5. The connector of claim 1, wherein:

the front retainer is formed with a butting portion, configured to be in contact with the housing from the front in a state assembled with the housing; and the locking projection is locked to bite into the locking surface with the butting portion butting against the housing.

6. The connector of claim 5, wherein the locking projection is locked to the housing from the front when the retaining projection is locked to bite into the locking surface with the front retainer held at the partial locking position.

* * * * *